US009726448B1

(12) United States Patent
Milde, Jr. et al.

(10) Patent No.: US 9,726,448 B1
(45) Date of Patent: Aug. 8, 2017

(54) SECURE SMARTPHONE-OPERATED LOCKING DEVICE

(71) Applicants: Karl F. Milde, Jr., Mahopac, NY (US); Jeffrey A. Matos, New Rochelle, NY (US)

(72) Inventors: Karl F. Milde, Jr., Mahopac, NY (US); Jeffrey A. Matos, New Rochelle, NY (US)

( * ) Notice: Subject to any disclaimer, the term of this patent is extended or adjusted under 35 U.S.C. 154(b) by 0 days.

(21) Appl. No.: 14/955,125

(22) Filed: Dec. 1, 2015

Related U.S. Application Data

(60) Continuation-in-part of application No. 14/511,222, filed on Oct. 10, 2014, now Pat. No. 9,222,740, which is a division of application No. 13/763,951, filed on Feb. 11, 2013, now Pat. No. 8,893,420.

(60) Provisional application No. 61/761,270, filed on Feb. 6, 2013.

(51) Int. Cl.
*G07C 9/00* (2006.01)
*F41A 17/06* (2006.01)

(52) U.S. Cl.
CPC ..... *F41A 17/063* (2013.01); *F41A 17/066* (2013.01); *G07C 9/00309* (2013.01); *G07C 2009/00325* (2013.01)

(58) Field of Classification Search
CPC ..... F41A 17/063; F41A 17/06; F41A 17/46; F41A 17/02; G07C 9/00; G07C 9/00174; G06F 3/0484; G06F 3/04842
USPC ..... 340/5.1–5.9
See application file for complete search history.

(56) References Cited

U.S. PATENT DOCUMENTS

| | | | |
|---|---|---|---|
| 4,354,189 | A | 10/1982 | Lemelson |
| 4,467,545 | A | 8/1984 | Shaw, Jr. |
| 4,682,435 | A | 7/1987 | Heltzel |
| 4,970,819 | A | 11/1990 | Mayhak |
| 5,062,232 | A | 11/1991 | Eppler |
| 5,448,847 | A | 9/1995 | Teetzel |
| 5,459,957 | A | 10/1995 | Winer |
| 5,461,812 | A | 10/1995 | Bennett |
| 5,502,915 | A | 4/1996 | Mendelsohn et al. |
| 5,570,528 | A | 11/1996 | Teetzel |
| 5,603,180 | A | 2/1997 | Houze |
| 5,636,464 | A | 6/1997 | Ciluffo |
| 5,713,149 | A | 2/1998 | Cady et al. |
| 5,896,691 | A | 4/1999 | Kaminski et al. |
| 5,937,557 | A | 8/1999 | Bowker et al. |
| 6,293,039 | B1 | 9/2001 | Fuchs |

(Continued)

FOREIGN PATENT DOCUMENTS

WO 2008151402 A2 12/2008

*Primary Examiner* — Allen T Cao
(74) *Attorney, Agent, or Firm* — Karl F. Milde, Jr.

(57) ABSTRACT

A battery-powered locking device, such as a trigger-lock which is configured to be disposed on a gun with a trigger for firing, includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired. A separate electronic gun key is provided to transmit gun unlock data to the data receiver of the trigger-locking device. This gun unlock data may be a password, a long pseudo-random number or biologic data identifying the gun owner or some other person who is licensed or otherwise authorized to fire the gun.

7 Claims, 5 Drawing Sheets

(56) References Cited

U.S. PATENT DOCUMENTS

| | | | | |
|---|---|---|---|---|
| 6,314,671 | B1 | 11/2001 | Gering | |
| 6,415,542 | B1 | 7/2002 | Bates et al. | |
| 6,421,943 | B1 | 7/2002 | Caulfield et al. | |
| 6,711,843 | B2 | 3/2004 | Klebes | |
| 6,711,844 | B2 | 3/2004 | Rumfelt | |
| 6,763,126 | B2 | 7/2004 | Recce | |
| 6,785,995 | B2 | 9/2004 | Herzog et al. | |
| 6,823,621 | B2 | 11/2004 | Gotfried | |
| 6,861,944 | B1 | 3/2005 | Hoepelman | |
| 7,030,729 | B2 | 4/2006 | Albanesi et al. | |
| 7,339,456 | B1 | 3/2008 | Buckley et al. | |
| 7,353,632 | B2 | 4/2008 | Newkirk et al. | |
| 7,356,959 | B2 | 4/2008 | Schmitter et al. | |
| 8,135,413 | B2 * | 3/2012 | Dupray ..... | H04W 4/02 455/456.1 |
| 8,205,372 | B2 | 6/2012 | Anzeloni | |
| 8,931,315 | B2 | 1/2015 | Frolov et al. | |
| 9,098,953 | B2 | 8/2015 | Kincaid et al. | |
| 2001/0032405 | A1 | 10/2001 | Kaminski | |
| 2001/0042332 | A1 | 11/2001 | Gering et al. | |
| 2002/0157296 | A1 | 10/2002 | Vivian et al. | |
| 2002/0174587 | A1 | 11/2002 | Rumfelt | |
| 2004/0244253 | A1 | 12/2004 | Glock | |
| 2007/0074438 | A1 | 4/2007 | Parhofer et al. | |
| 2008/0039962 | A1 | 2/2008 | McRae | |
| 2008/0134556 | A1 | 6/2008 | Remelin | |
| 2008/0244699 | A1 | 10/2008 | Parhofer et al. | |
| 2009/0223104 | A1 | 9/2009 | Anzeloni | |
| 2011/0061280 | A1 | 3/2011 | Emde et al. | |
| 2011/0173869 | A1 | 7/2011 | Uhm | |
| 2012/0151814 | A1 | 6/2012 | Dietel | |
| 2012/0180357 | A1 | 7/2012 | Dietel et al. | |
| 2013/0125441 | A1 | 5/2013 | Westwood et al. | |
| 2013/0312306 | A1 | 11/2013 | Ruffin | |
| 2014/0057255 | A1 * | 2/2014 | Holmes ..... | G06F 19/366 435/6.11 |
| 2014/0215885 | A1 | 8/2014 | Sullivan et al. | |
| 2014/0230301 | A1 | 8/2014 | Chance et al. | |
| 2014/0335505 | A1 * | 11/2014 | Holmes ..... | G06F 19/366 435/5 |

* cited by examiner

SECURE SMARTPHONE-OPERATED LOCKING DEVICE

CROSS-REFERENCE TO RELATED APPLICATIONS

This application claims priority from Provisional Application No. 61/761,270 filed Feb. 6, 2013, entitled "SECURE SMARTPHONE-OPERATED GUN TRIGGER LOCK" through the following series of applications:

This application is a continuation-in-part of U.S. patent application Ser. No. 14/511,222, filed Oct. 10, 2014, entitled "SECURE SMARTPHONE-OPERATED LOCKING DEVICE" (now allowed) which application, in turn, is a division of application Ser. No. 13/763,951 filed Feb. 11, 2013, entitled "SECURE SMARTPHONE-OPERATED GUN TRIGGER LOCK" (now U.S. Pat. No. 8,893,420).

BACKGROUND OF THE INVENTION

The present invention relates, generally, to a lock of any type and to an app-enabled smartphone for remotely controlling, e.g., opening and closing, the lock.

In a principal, preferred embodiment the present invention relates to a lock for a trigger-operated gun that is installed on the gun in a position behind the trigger to prevent the trigger from firing the gun.

Mechanical gun-locks are designed to be installed on the gun in a position behind the trigger to prevent the trigger from firing the gun. These gun-locks use a mechanical key that can be easily duplicated, and the locks themselves can be compromised by means of a master key or a lock pick.

Furthermore, such gun-locks can be opened by anyone in possession of one of the keys. With such gun-locks it is not possible to restrict the use of the gun to the gun owner or to some other person who is licensed or otherwise authorized to use the gun.

In another preferred embodiment the present invention relates to a lock for a door, such as a deadbolt lock with a lock mechanism for moving the deadbolt in and out of the locked position. The lock employs a battery or mains-operated electromechanical device for moving the lock mechanism in response to an electrical control signal.

Deadbolt locks of this type are well known for example from U.S. Pat. Nos. 8,931,315 and 9,098,953 assigned to Schlage Lock Company, LLC. The electrical control signal is generated when a numerical passcode, such as a four-digit code, is entered on a lock keypad or into an app-enabled smartphone that, in turn, wirelessly transmits a passcode signal to the lock. When the entered passcode matches one of the authorized codes previously stored in either the smartphone or the lock itself, an electronic circuit within the lock produces the electrical signal causing the electromechanical device to open the lock.

This known lock has the drawback that a four-digit, or even a higher-digit passcode is readily hackable. It also has the disadvantage that a person authorized to unlock the lock may forget the passcode or, conversely, may have shared it with a friend or family member who, in turn, has shared it with one or more unknown parties who can unlock the lock.

SUMMARY OF THE INVENTION

It is a principal object of the present invention to provide a gun-lock for a trigger-operated gun which is difficult to compromise and allows only the gun owner, or some other person authorized by the gun owner, to use the gun.

It is a further object of the present invention to provide a lock generally, such as a deadbolt lock for a door, which avoids the aforesaid drawbacks of a passcode-operated lock.

This objects, as well as other objects which will become apparent from the discussion that follows, are achieved, in accordance with the present invention, by providing a battery-powered trigger-locking device which is configured to be disposed on a gun of the type having a trigger for firing. The trigger-locking device includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired.

According to a preferred embodiment of the invention, the gun-lock device according to the invention further comprises an electronic gun key having a data transmitter for transmitting gun unlock data to the data receiver of the trigger-locking device. This gun unlock data may be a password, a long pseudo-random (and therefore hack-resistant) number or biologic data identifying the gun owner or some other person who is licensed or otherwise authorized to use the gun.

More particularly, the trigger-locking device includes:

(a) a stationary member configured to be permanently installed on the gun in a position behind the trigger;

(b) a movable member, movably connected to the stationary member and movable between a locked first position which prevents the trigger from firing the gun and an unlocked second position which enables firing;

(c) electromechanical apparatus disposed on the stationary member for moving the movable member between the first position and the second position in response to at least one electric signal;

(d) a data receiver for receiving a gun unlock signal with gun unlock data;

(e) a data memory for storing data; and (f) a first logic device, coupled to the data receiver and to the data memory, for comparing the gun unlock data received by the receiver with data stored in the memory upon receipt of the gun unlock signal, and for producing the at least one electric signal to actuate the electromechanical apparatus in dependence upon whether the stored data and the received data are substantially the same.

The first logic device is operative in this trigger-locking device to cause the electromechanical apparatus to:

- move the movable member to the second position when the gun unlock data received by the receiver is substantially the same as the data stored in the memory, and
- maintain the movable member in the first position at all other times, thereby to prevent unauthorized operation of the gun.

The data receiver is further operative to receive a gun-lock signal, and the first logic device, upon receipt of the gun-lock signal, is operative to cause the electromagnetic apparatus to move the movable member to the first (locked) position.

The first logic device, upon producing the electric signal, may cause the electromagnetic apparatus to move the movable member to the second position for a first duration of time, and thereafter to move the movable member back to the first position. The first duration of time is preferably selected from the group consisting of:

(i) less than 1 minute;

(ii) a range of time from 1 minute to 5 minutes;

(iii) a range of time from more than 5 minutes to 30 minutes; and (iv) more than 30 minutes.

In an alternative embodiment of the invention, the movable member, after being moved to the second/unlocked position remains in that position until a gun-lock signal is received by the data receiver.

A gun key device has a data transmitter for transmitting gun unlock data to the data receiver in the trigger-locking device. As mentioned above, the gun unlock data may include a password, a pseudo random number or data identifying a putative authorized person who wishes to use the gun. The pseudo-random number is preferably generated by the gun key device when the gun is first used.

According to a preferred embodiment of the invention, the gun key device further comprises:

(a) an input device, for inputting information from a putative authorized person who wishes to unlock the gun; and (b) a second logic device, coupled to both the data transmitter and the input device, for generating gun unlock data defined by the putative authorized person and for causing the data transmitter to transmit the gun unlock data to the data receiver. The putative authorized person is recognized as an authorized person if the gun unlock data substantially matches the stored data in the trigger lock data memory.

When a biologic identifier is used to unlock the gun-lock, the data stored in the memory of the trigger lock may include at least one biologic identifier of the owner or an authorized person.

The input device of the gun key may be a camera, for example. In this case, the camera is operative to record an image of the putative authorized person as a biologic identifier, which image may be:

a facial image;

an mage of an iris;

a retinal age;

a fingerprint;

a palm print; and an image of veins of a hand;

The second logic device is then operative to process the image and to generate the gun unlock data therefrom.

Alternatively, the input device may be a microphone. The second logic device is then operative to process a voiceprint of the putative authorized person as a biologic identifier and to generate the gun unlock data therefrom.

Finally, the input device may be an alphanumeric keyboard, whereby:

(i) the putative authorized person may input an alphanumeric code; and (ii) the putative authorized person is recognized as an authorized person in the event the inputted code matches the stored data.

The trigger-locking device preferably comprises a first battery for providing power to at least one of the logic device, the data receiver and the data memory and a second battery for providing power to the electromechanical apparatus which is power thirsty compared to the electronic devices.

Preferably, an electric device is provided for selectively utilizing the still-functional battery when one of the two batteries is depleted.

Preferably also, the electromechanical apparatus is operative to move the movable member to the first position in the event of battery depletion.

Advantageously, the data memory comprises at least one write-once-only element to prevent degradation of the data stored in the memory and to prevent the data stored in the memory from being changed. The write-once-only element may be a PROM, an EPROM or an EEPROM, for example.

According to a preferred embodiment of the invention, the gun-lock apparatus comprises at least one tamper detecting device, situated in proximity to the trigger-locking device, for detecting external manipulation of at least one of (1) the logic device, the (2) electromechanical apparatus, and (3) the moveable member. This tamper detecting device preferably generates a tamper signal upon the detection of the external manipulation, which tamper signal causes the electromechanical apparatus to maintain the movable member in the first position for a second duration of time. The tamper detecting device may be a separate element or it may be implemented by the first logic device.

Advantageously, the trigger-locking device comprises a transmitting device, coupled to the tamper detecting device, for transmitting an alarm upon generation of the tamper signal.

According to still another preferred embodiment of the present invention, the data memory may be operative to store identifying information of a registration person authorized to input data to the data memory which identifies the authorized person. In this case, the first logic device is made operative to store data concerning a person authorized to use the gun, in the data memory only if the authorized person identification information is accompanied by identification of a putative registration person that substantially matches the stored registration person identification information. Also, the first logic device is made operative to change the data stored in the data memory only if the identification information accompanied by identification of a putative registration person that substantially matches the stored registration person identification information.

Finally, according to still another preferred embodiment of the present invention, the electromechanical apparatus includes an electric motor coupled to a gear reduction mechanism for rotating a cam. The movable member of the trigger-locking device is moved by the cam between the locked first position and the unlocked second position.

Alternatively, the electric motor may be a servo-motor which is coupled mechanically to the movable member to move this member back and forth between the two positions.

In yet another alternative embodiment of the invention, an electromagnetically controlled two position-switching device may be used to control the position of movable member.

Finally, in a more general application and embodiment of the invention, smartphone-enabled locking apparatus is provided which comprises two elements, (a) and (b) as follows:

(a) a locking device, configured to be installed on an item to be secured to prevent the unauthorized use of the tem, having a first source of electrical power and including, in combination:

(1) a locking member, movable between a locked position and an unlocked position;

(2) an electromechanical device coupled to the first source of power and to the locking member for moving the locking member from the locked position to the unlocked position in response to at least one electric signal;

(3) a wireless receiving ("R") device, coupled to the first source of power, for receiving second unlock data;

(4) a first data memory, coupled to the first source of power, for storing first unlock data pertaining to an authorized person who is authorized to unlock the locking device; and (5) a first logic device, coupled to the first source of power, to the R device and to the first data memory, for comparing the second unlock data received by the R device with the first unlock data stored in the first data memory and for producing the at least one electric signal to actuate the electromechanical device, and thereby move the locking member to the unlocked position, when the first unlock data stored in the first data memory and the second unlock data received by the R device are substantially the same.

(b) a phone app for a portable smartphone which includes a second source of electrical power and comprises the following components:

(1) a wireless transmitting ("T") device coupled to the second source of power for transmitting the second unlock data to the R device;

(2) a second data memory, coupled to the second source of power, for storing the second unlock data;

(3) a second logic device, coupled to the second source of power, to the T device and to the second data memory; and (4) an input device, coupled to the second logic device and to the second source of power, for producing digital data representing biologic identifying information about a putative authorized person who wishes to unlock the locking device, the phone app being operative to control the second logic device (i) to generate the second unlock data from the biologic identifying information, to store the second unlock data in the second data memory and (iii) to cause the T device to transmit the second unlock data to the R device; thereby to unlock the locking device when the second unlock data stored in the second data memory and transmitted to the locking device is substantially the same as the first unlock data stored in the first data memory.

In one preferred embodiment, the input device includes a camera, coupled to the second logic device, for inputting an image of a bodily aspect of the putative authorized person as the biologic identifying information ("bioID"). The second logic device is operative to receive the digital data representing the image as the bioID and to generate the second unlock data therefrom. To enhance security the second logic device is programmed to determine whether the bioID of said putative authorized person is the bioID of an actual living person.

In another preferred embodiment, the input device includes a microphone, coupled to the second logic device, for inputting a voice of the putative authorized person as the biologic identifying information, wherein the second logic device is operative to receive the digital data representing the voice as the biologic identifying information and to generate the second unlock data therefrom.

In a particularly advantageous implementation of the invention, the portable smartphone further includes a keypad, coupled to the second logic device, for inputting alphanumeric data, and the second logic device is further operative to process a password entered into the keypad by the putative authorized person and to generate the second unlock data therefrom.

According to a further preferred embodiment, the portable smartphone further includes a keypad, coupled to the second logic device, for inputting alphanumeric data whereby a person may input a lock command, and wherein the second logic device is further operative to generate a lock signal representing the lock command, the data receiver is further operative to receive the lock signal, and the first logic device, upon receipt of the lock signal, is operative to produce at least one electric signal to actuate the electromechanical device and thereby move the locking member to the locked position.

For a full understanding of the present invention, reference should now be made to the following detailed description of the preferred embodiments of the invention as illustrated in the accompanying drawings.

BRIEF DESCRIPTION OF THE DRAWINGS

FIG. 5, comprising

DETAILED DESCRIPTION OF THE PREFERRED EMBODIMENTS

Figure 1:
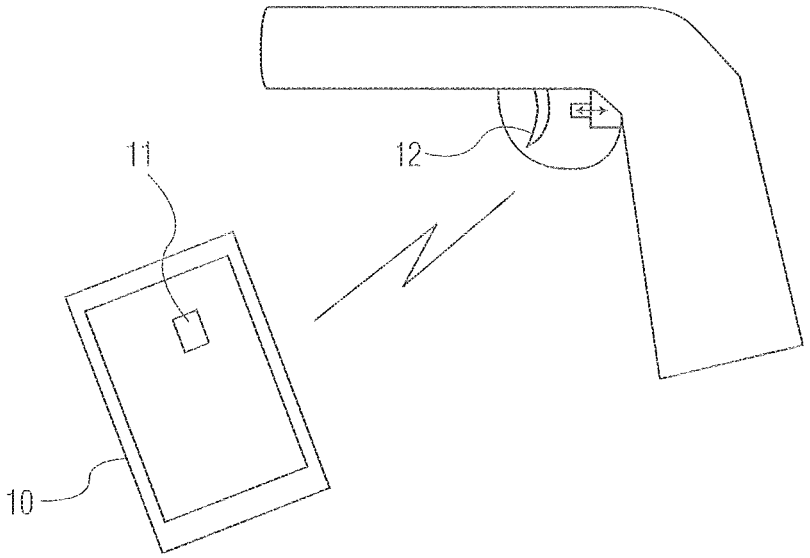
FIG. 1 is a representational diagram showing a smartphone and a gun that is equipped with a gun-lock according to the present invention.

The preferred embodiments of the present invention will now be described with reference to FIGS. 1-6 of the drawings. Identical elements in the various figures are identified with the same reference numerals.

Briefly in overview, a battery-operated trigger-locking device is permanently attached to/installed in a gun in a recess behind the trigger in the lower receiver mechanism. In its default condition, a movable member is in a forward position, blocking rearward movement of the trigger. When unlocked, the movable member is drawn rearward to allow movement of the trigger.

The trigger-locking device has a Bluetooth (or other type) receiver and a stored number. When this particular number is received from a smartphone or similar device, the trigger-locking device moves the movable member rearward releasing the trigger FIG. 1 illustrates this configuration. A smartphone 10 has an App 11 called "Gunlock" that presents a separate button called "Gun Unlock" for each gun the smartphone owner owns or is licensed to use. By pressing the button on the App, the owner sends a password, a pseudo-random number or biologic ID data by a Bluetooth wireless connection to a trigger-locking device 12 installed permanently in a gun, e.g. by a strong adhesive.

Figure 2:
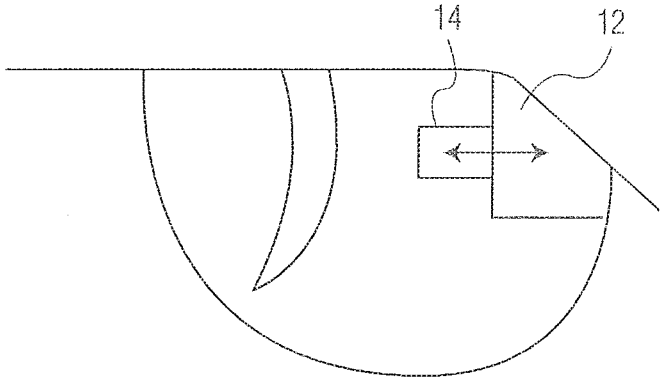
FIG. 2 is a close-up view of the trigger region of the gun of FIG. 1 with the gun-lock installed.

FIG. 2 shows the trigger-locking device 12 with a movable member 14. When the device receives a data packet that matches the corresponding data stored in its memory, it draws the movable member 14 back, allowing the trigger to fire the weapon.

The smartphone can be made secure in any number of ways. It can be password protected or, preferably, it can use of its camera to verify the ID of the person holding this device. For example, the security App may use face recognition or iris recognition software to identify the owner from the camera image.

When the trigger lock 12 is first used, the Gunlock App can generate a pseudo-random number and send it to the trigger-locking device for storage in its permanent memory. Once stored, this number can be changed only by an authorized person, such as the gun owner, or a "registration person" that is duly licensed to perform this function, e.g. by a local or national government. Thereafter, whenever the smartphone sends this number again, the trigger-locking device releases the trigger so the gun may be fired. Before sending the unlock number, the user of the smartphone may be required to identify himself/herself by entering biologic identifying information into the phone for a recognition algorithm. Alternatively, the biologic ID information may be sent to the trigger-locking device for matching with corresponding biologic identifying data stored therein. In this case, the biologic identifying data, rather than an unlock number must be originally sent and stored in the data memory.

Firing the gun is therefore a two-step process for the gun owner or authorized user:

(1) Verify his/her identity with the smartphone; and (2) Press the Gun Unlock button to enable the trigger lock to release the trigger.

The trigger remains unlocked until the gun user presses another button on the Gunlock app, appropriately called "Gun-lock," or until the trigger lock times out and automatically locks itself by restoring the movable member to the locked position.

The trigger-locking device 12 is preferably powered by a replaceable and/or rechargeable battery (not shown).

Figure 3:
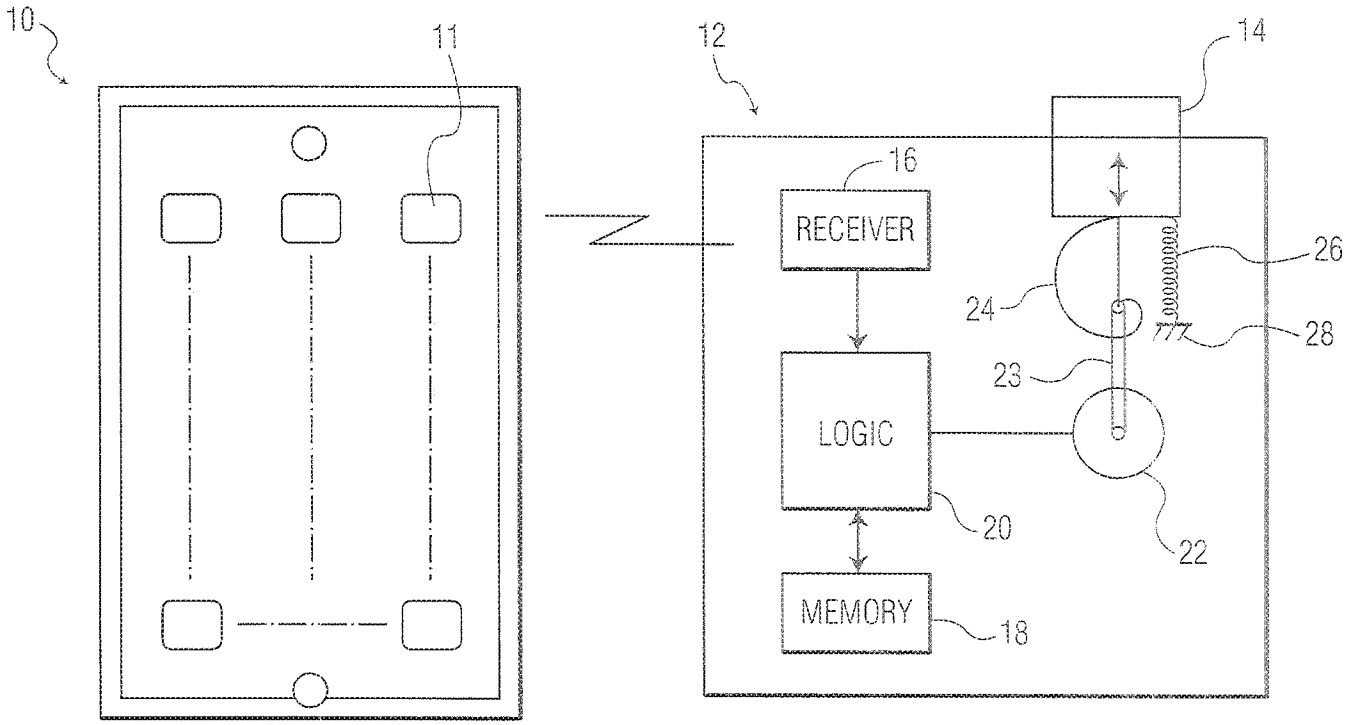
FIG. 3 is a block diagram showing a preferred embodiment of the gun-lock apparatus according to the present invention.

FIG. 3 shows the individual elements of the gun-lock apparatus. The smartphone 10 transmits to a receiver 16 in the trigger-locking device 12, preferably via a wireless Bluetooth connection. Alternatively, the smartphone may be coupled to the receiver by a wire connection, for example through a USE port. The receiver 16 and a data memory 18 are both coupled to a logic device 20 that compares the data received from both the receiver and the memory and sends an electric signal to an electromechanical device 22 when and if there is a match.

If biologic ID data has been sent to the receiver by the smartphone 10, the data may not be an exact match; however, the received signature data may be sufficiently close to the stored signature data to satisfy the requirement that the person holding the smartphone is indeed the owner of the gun.

The electromechanical device is preferably a micro-motor 22 that turns a shaft 23 through a speed reduction gear mechanism. In this way, a very small motor may generate sufficient torque to move the movable member 14 between a locked position, adjacent the gun trigger, and an unlocked position which permits the trigger to fire the gun. The relatively large forces that may be applied against the movable member by the trigger when in the locked position are taken up by a rotatable cam 24, that presses against the movable member against the force of a spring 28. The spring 28, which is connected to a stationary member attached to the gun, biases the movable member 14 toward the unlocked position. The cam 24 abuts a cam surface on the underside of the movable member 14 and, as it rotates, it moves the movable member toward the locked position adjacent the trigger.

Figure 4:
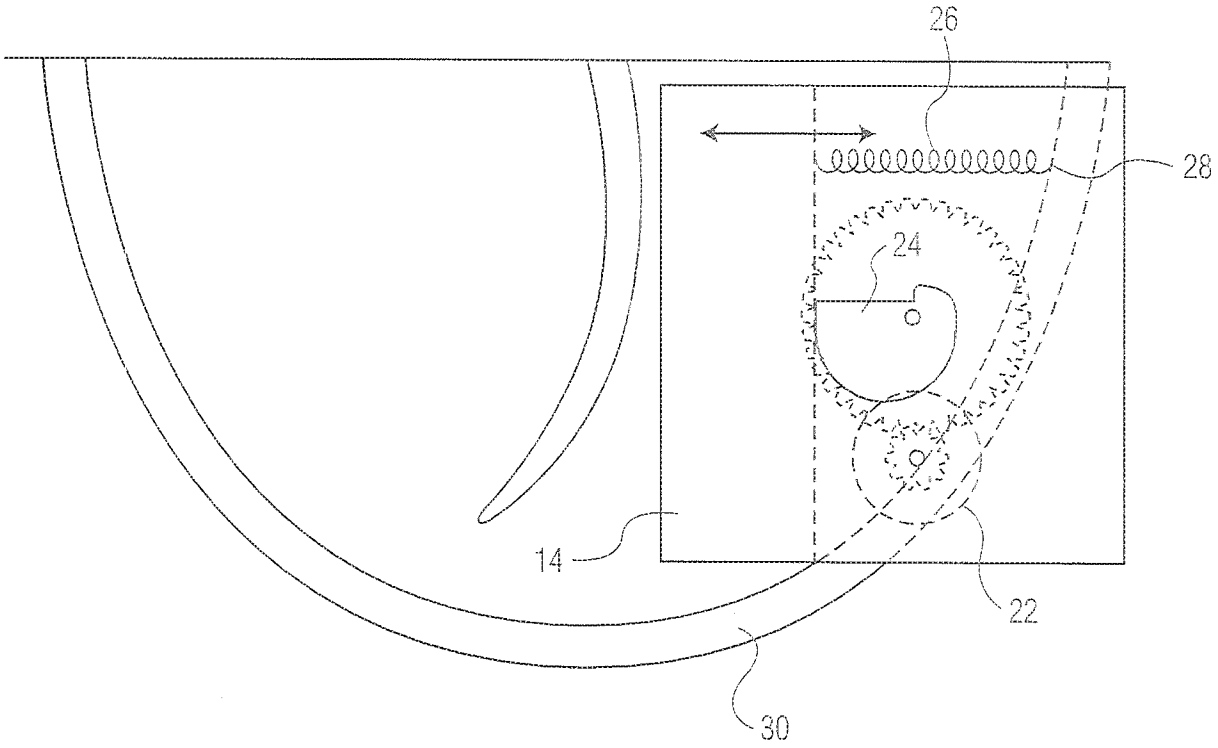
FIG. 4 is a detailed, representational diagram showing a preferred embodiment of the trigger-locking device of the present invention.

FIG. 4 illustrates this electromechanical mechanism in greater detail. The cam 24 is arranged on the reduction gear 23 which is driven by a small gear on the shaft of the motor 22. The spring 26, which is attached at 28 to the trigger guard 30, biases the moveable member in the unlocked position. The cam presses against a flat surface 32 on the inside of the moveable member 14 to move the member 14 to the locked position.

Alternatively, a servo-motor can be substituted for the motor and cam mechanism to move the movable member 14.

The movable member 14 surrounds the trigger guard 30 of the gun in such a way as to prevent tampering. Preferably a tamper detecting device is provided which signals the logic device 20 when it detects tampering so that this device can (1) signal the motor 22 to move the movable member 14 into the locked position, and (2) sound or transmit a warning signal.

Figure 5A:
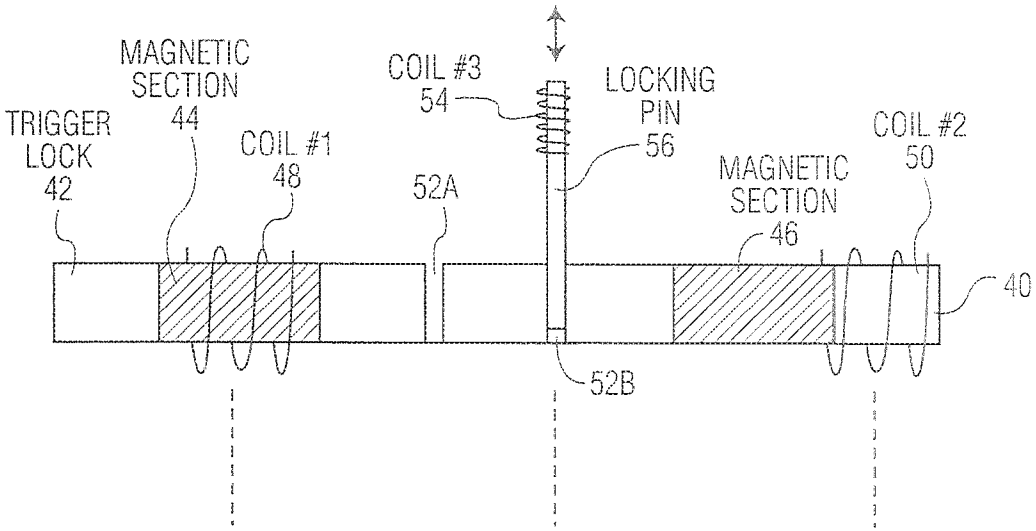
FIGS. 5A and 5B, is a representational diagram showing an alternative embodiment of the electromechanical apparatus used in the trigger-locking device.

FIG. 5 illustrates an alternative embodiment of the electromechanical apparatus for locking and unlocking the trigger-locking device. FIG. 5A shows a movable armature 40 in the locked posit (i.e., moved linearly to the left in the figure). This armature presses against the moveable member 14 of the locking device, preventing actuation of the gun trigger. Sections 44 and 46 of the armature contain magnetic material that is actuated by coils 48 and 50. The armature is held in position by a locking pin 56 that is selectively pressed by a third coil 54 into receptacles or detents 52A and 52B in the armature to fix the armature in the unlocked and locked positions, respectively.

Figure 5B:
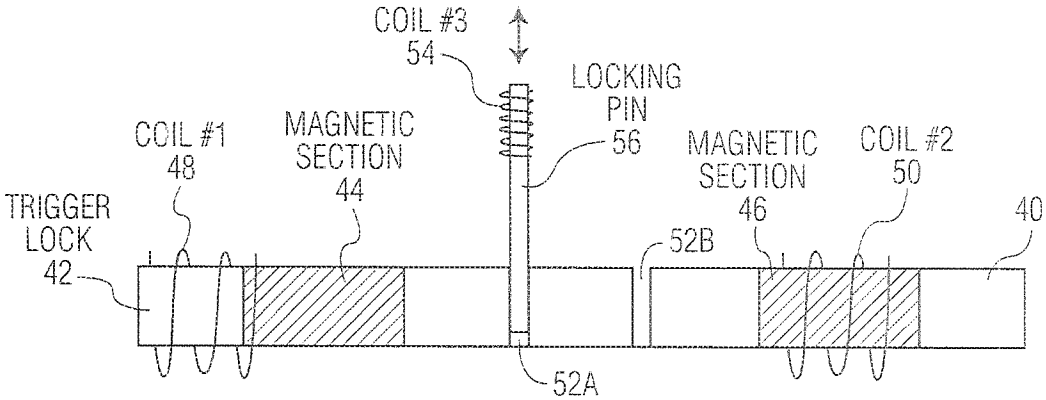

FIG. 5B shows the armature in the unlocked position (moved to the right in the figure).

Figure 6:
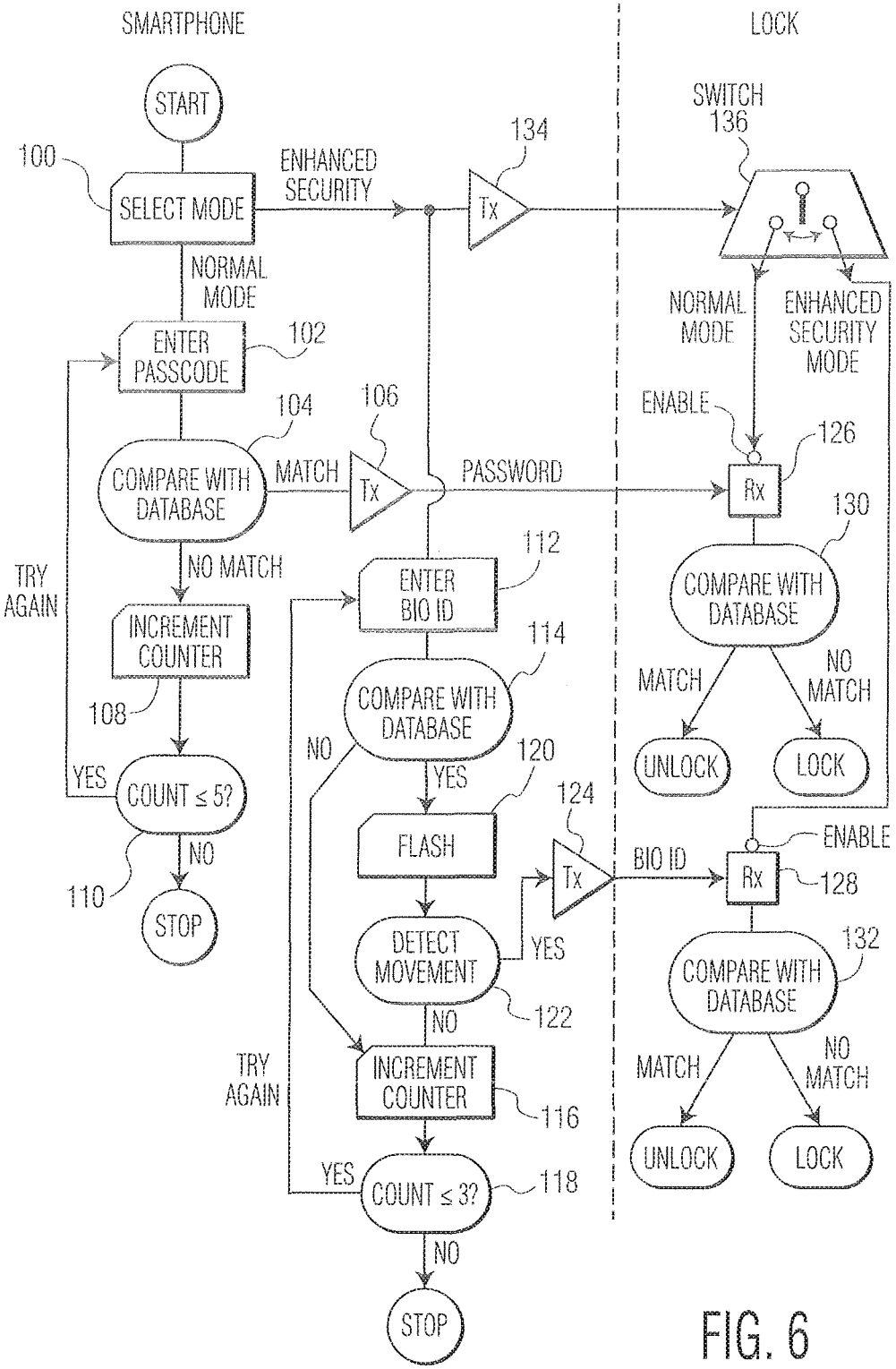
FIG. 6 is a flowchart explaining the operation of a smartphone-enabled lock with enhanced security in accordance with the present invention.

FIG. 6 is a flowchart detailing the operation of the smartphone-enabled lock. The left-hand side of the chart is an exemplary algorithm for the phone-app, whereas the right-hand side illustrates the operation of the lock.

When someone wishes to unlock the lock, the first step is to select a mode on the smartphone as shown by the block 100. The person can select between a "normal mode," in which only a passcode is used to unlock the lock, or an "enhanced security mode," in which biologic identifying information is captured by the smartphone and compared with the prestored bioIDs of any number of authorized persons to unlock the lock.

In the normal mode the person enters an alphanumeric code, such as a four-digit number, in block 102, which code is compared to pre-stored passcodes in the smartphone memory at block 104. If there is a match with one of the stored passcodes, the same or a different passcode is transmitted to the lock by transmitter 106. If there is no match, a "trial counter," which has been initialized to zero at the start of the process, is incremented by one at block 108. The trial count is then compared in block 110 to a number, such as five, which will be the number of times the person is allowed to try to open the lock with a passcode. If the count is less than or equal to five, the person is prompted to enter another passcode. It the count in the trial counter exceeds five, the unlocking process in the normal mode ceases.

If enhanced security is desired, the smartphone can be set to accept only the enhanced security mode. In this case, the person who wishes to unlock the lock must enter biologic identification information ("bioID") in the smartphone, for example by taking a "selfie" (facial image or iris image) using the smartphone camera or by speaking into the smartphone microphone, in block 112. This bioID is compared with pre-stored bioIDs of persons authorized to open the lock in block 114. If no match is found, a second trial counter is incremented in block 116 and the trial count is compared to a maximum number of tries, such as three, in block 118. If the count is less than or equal to three, the person as allowed to enter another bioID (either the same or of a different type). If the count exceeds three, the process is stopped.

If a match with the bioID is found, the smartphone may cause its light to flash in block 120 to involuntarily reduce the person's iris size, or it may take a video to detect a persons facial movement, such as eye's blinking, to detect movement, in block 122, to ensure that the person is real (not a photograph). If movement is detected, a signal representing the bioID is transmitted to the lock via transmitter 124.

As shown in the right side of the flowchart, a receiver 126 or 128 in the lock receives the passcode or bioID, respectively, and this information is compared, in blocks 130 and 132, to pre-stored passcodes or bioIDs, respectively, associated with those persons who are authorized to unlock the lock.

Once an authorized person has been identified, that person is authorized not only to unlock the lock, but also lock it as well.

The lock is instructed to respond to either the normal mode or the enhanced security mode from a signal received from a transmitter 134 which actuates a toggle swatch 136. When operating in the normal mode the switch 136 maintains an enable signal on the receiver 126 and removes it from receiver 128. Conversely, when in the enhanced security mode the switch 136 maintains an enable signal on the receiver 218 and removes it from receiver 126.

It will be understood that the transmitters 106, 124 and 134 may be one in the same transmitter.

There has thus been shown and described a novel secure smartphone-operated lock which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Locking apparatus which is unlocked only by an authorized person, said apparatus comprising:

(a) a locking device, configured to be installed on an item to be secured to prevent the unauthorized use of the item, having a first source of electrical power and including, in combination:

(1) a locking member, movable between a locked position and an unlocked position;

(2) an electromechanical device coupled to the first source of power and to the locking member for moving the locking member from the locked position to the unlocked position in response to at least one first electric signal;

(3) a wireless receiving ("R") device, coupled to the first source of power, for receiving second unlock data;

(4) a first data memory, coupled to the first source of power, for storing first unlock data pertaining to an authorized person who is authorized to unlock the locking device, said first unlock data representing biologic identifying information ("bioID") about at least one person who is authorized to unlock the locking device; and (5) a first logic device, coupled to the first source of power, to the R device and to the first data memory, for comparing said second unlock data received by the R device with said first unlock data stored in the first data memory and for producing said at least one first electric signal to cause the electromechanical device to move the locking member from the locked position to the unlocked position, when the first unlock data stored in said first data memory and the second unlock data received by the R device are substantially the same;

(b) a phone app for a portable smartphone which includes a second source of electrical power and comprises the following components:

(1) a wireless transmitting ("T") device coupled to said second source of power for transmitting said second unlock data to said R device;

(2) a second data memory, coupled to said second source of power, for storing said second unlock data;

(3) a second logic device, coupled to said second source of power, to said T device and to said second data memory; and (4) an input device, coupled to said second logic device and to said second source of power, for producing digital data representing biologic identifying information ("bioID") pertaining to a putative authorized person who wishes to unlock the locking device, said phone app being operative to control said second logic device (i) to generate said second unlock data from said bioID, (ii) to store said second unlock data in said second data memory and (iii) to cause said T device to transmit said second unlock data to said R device;

thereby to unlock said locking device when said second unlock data stored in said second data memory and transmitted to said locking device is substantially the same as said first unlock data stored in said first data memory.

2. The locking apparatus of claim 1, wherein said input device includes a camera, coupled to said second logic device, for inputting an image of a bodily aspect of said putative authorized person as said biologic identifying information, and wherein the second logic device is operative to receive said digital data representing said image as said biologic identifying information and to generate said second unlock data therefrom.

3. The locking apparatus of claim 1, wherein said input device includes a microphone, coupled to said second logic device, for inputting a voice of said putative authorized person as said biologic identifying information, and wherein the second logic device is operative to receive said digital data representing said voice as said biologic identifying information and to generate said second unlock data therefrom.

4. The locking apparatus of claim 1, wherein the portable smartphone further includes a keypad, coupled to said second logic device, for inputting alphanumeric data, and wherein the second logic device is further operative to process a password entered into the keypad by the putative authorized person and to generate said second unlock data therefrom for transmission by said T device to said R device, thereby to unlock the locking device when enhanced security in not required.

5. The locking apparatus of claim 1, wherein the portable smartphone further includes a keypad, coupled to said second logic device, for inputting alphanumeric data whereby a person may enter a lock command, and wherein the second logic device is further operative in response to said input to generate a lock signal representing said lock command, said data receiver as further operative to receive said lock signal, and said first logic device, upon receipt of said lock signal, is operative to produce at least one second electric signal to cause the electromechanical device to move the locking member from the unlocked position to the locked position.

6. The locking apparatus of claim 1, wherein said phone app is further operative to control said second logic device to determine whether the bioID of said putative authorized person is the bioID of a living person, and to cause said T device to transmit said second unlock data to said R device only if the bioID is determined to be that from a living person.

7. The locking apparatus of claim 6, wherein said input device includes a camera, coupled to said second logic device, for inputting an image of a bodily aspect of said putative authorized person as said biologic identifying information, wherein said smartphone includes a light, and wherein said phone app is further operative (i) to cause said light to illuminate, thereby to cause said putative authorized person to move involuntarily, causing a change in said image, and (ii) to recognize said change in said image as a determination that said image was made from a living person.

* * * * *